US009076586B2

(12) United States Patent
Atsumi et al.

(10) Patent No.: US 9,076,586 B2
(45) Date of Patent: Jul. 7, 2015

(54) COIL COMPONENT

(71) Applicant: PANASONIC CORPORATION, Osaka (JP)

(72) Inventors: Toshiyuki Atsumi, Hyogo (JP); Mutsuyasu Ohtsubo, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 38 days.

(21) Appl. No.: 14/079,529

(22) Filed: Nov. 13, 2013

(65) Prior Publication Data

US 2014/0210586 A1 Jul. 31, 2014

(30) Foreign Application Priority Data

Jan. 31, 2013 (JP) ..... 2013-016527

(51) Int. Cl.

| | |
|---|---|
| ***H01F 27/02*** | (2006.01) |
| ***H01F 27/06*** | (2006.01) |
| ***H01F 27/29*** | (2006.01) |
| ***H01F 5/00*** | (2006.01) |
| *H01F 17/04* | (2006.01) |

(52) U.S. Cl.
CPC ..... *H01F 27/292* (2013.01); *H01F 2017/048* (2013.01)

(58) Field of Classification Search
CPC ..... H01F 27/02
USPC ..... 336/65, 83, 90, 96, 192, 200, 232
See application file for complete search history.

(56) References Cited

U.S. PATENT DOCUMENTS

| | | | | |
|---|---|---|---|---|
| 2004/0189430 | A1* | 9/2004 | Matsutani et al. | 336/83 |
| 2004/0189431 | A1* | 9/2004 | Shibata et al. | 336/83 |
| 2008/0290975 | A1* | 11/2008 | Watanabe | 336/90 |
| 2009/0128275 | A1 | 5/2009 | Yagasaki et al. | |
| 2010/0007451 | A1* | 1/2010 | Yan et al. | 336/90 |
| 2010/0328003 | A1* | 12/2010 | Shibuya et al. | 336/90 |
| 2011/0260821 | A1* | 10/2011 | Yamada et al. | 336/192 |

FOREIGN PATENT DOCUMENTS

| | | |
|---|---|---|
| JP | 2009-123927 A | 6/2009 |
| JP | 2013-033841 A | 2/2013 |

* cited by examiner

*Primary Examiner* — Tsz Chan
(74) *Attorney, Agent, or Firm* — McDermott Will & Emery LLP

(57) ABSTRACT

A coil component includes a coil element, a body having a square pole shape which accommodates the coil component therein, and a pair of terminals. The first ends of the terminals are respectively fixed to the side surfaces, opposite to each other, of the body. The terminals are bent from the side surfaces toward the bottom surface of the body. The second end of each of the terminals includes corner parts at the both side portions thereof. The bottom surface of the body is provided with recesses at locations not overlapping with the coil component, viewed from the bottom surface. The recesses are recessed from the bottom surface of the body and penetrating to one of the side surfaces. The corner parts of the terminals are locked on the bottom surface of the body, by being bent along inner walls of the recesses.

11 Claims, 8 Drawing Sheets

COIL COMPONENT

RELATED APPLICATIONS

This application claims the benefit of Japanese Application No. 2013-016527, filed on Jan. 31, 2013, the disclosure of which Application is incorporated by reference herein.

BACKGROUND

1. Technical Field

The technical field disclosed herein relates to coil components for use in a variety of electronic devices.

2. Background Art

In recent years, automobiles have made much progress in electronic control of their drivelines and control systems, resulting in many electronic controlled devices installed in the automobiles. Such electronic controlled devices have been required to provide further miniaturization and high reliability. Therefore, a coil component which is available for surface mounting and has high reliability for automotive components is required. An example in which a conventional coil component is used will be described with reference to the accompanying drawings. FIG. 12 is a plan view of the conventional coil component. FIG. 13 is a cross-sectional view taken along line 13-13 in FIG. 12, illustrating a state in which the coil component is mounted on a circuit board.

The conventional coil component includes coil element 1, body 2, lead wires 3, and terminals 4. Coil element 1 is formed by winding a copper wire covered with an insulating film. Body 2 is formed by pressure molding of a mixed powder of a magnetic metal powder and a thermosetting resin serving as a binder. In the pressure molding, coil element 1 is buried in the mixed power. Lead wires 3 at both ends of coil component 1 protrude from the side surfaces of body 2. Each of terminals 4 of a surface-mounting type is formed by flattening out lead wire 3 in a plate shape and bending it from one of the side surfaces toward the bottom surface of body 2. The coil component is mounted on lands 6 of board 5 with solder 7 by using a reflow soldering bath.

SUMMARY

A coil component according to the present embodiment includes a coil element, a body having a square pole shape, a first terminal, and a second terminal. The body accommodates the coil element therein. The body includes a first side surface, a second side surface opposite to the first side surface, a third side surface orthogonal to the first side surface, a fourth side surface opposite to the third side surface, and a bottom surface orthogonal to the first to fourth side surfaces. The first terminal is coupled with the coil element and includes a first end fixed on the first side surface of the body, and a second end disposed on the bottom surface of the body. The second end includes a pair of corner parts located at both side portions thereof. The first terminal is formed by bending a plate material from the first side surface toward the bottom surface. The second terminal is coupled with the coil element and includes a first end fixed on the second side surface of the body, and a second end disposed on the bottom surface of the body. The second end includes a pair of corner parts located at both side portions thereof. The second terminal is formed by bending a plate material from the second side surface toward the bottom surface. The bottom surface of the body is provided with first to fourth recesses recessed from the bottom of the body. The first and third recesses penetrate to the third side surface, while the second and fourth recesses penetrate to the fourth side surface. The pair of the corner parts of the first terminal are bent along the inner walls of the first and second recesses, respectively, so as to be locked on the bottom surface of the body. The pair of the corner parts of the second terminal are bent along the inner walls of the third and fourth recesses, respectively, so as to be locked on the bottom surface of the body. The first to fourth recesses are located so as not to overlap with the coil element, viewed from the bottom surface of the body.

DESCRIPTION OF EMBODIMENTS

Figure 12:
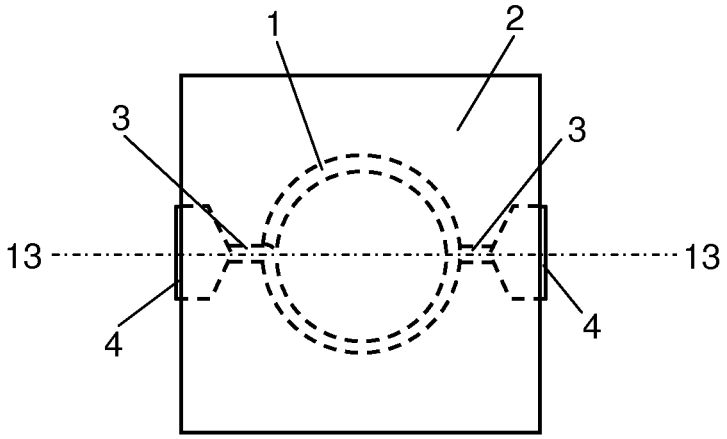
FIG. 12 PRIOR ART
FIG. 12 is a plan view of a conventional coil component.
Figure 13:
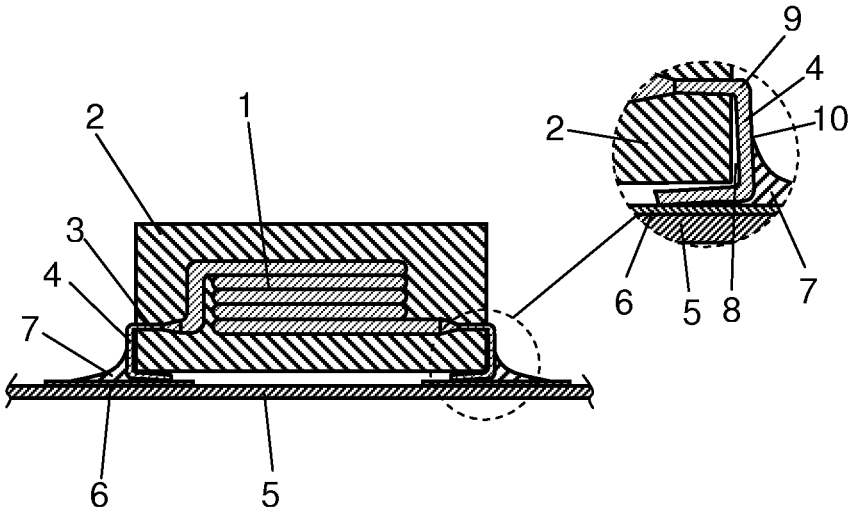
FIG. 13 PRIOR ART
FIG. 13 is a cross-sectional view of the coil component taken along line 13-13 of FIG. 12.

Prior to descriptions of the embodiments, problems facing the conventional coil component shown in FIGS. 12 and 13 will be described. As described above, terminals 4 are bent from the side surfaces of body 2 toward the bottom surface in the conventional coil component. Accordingly, gap 8 may appear between terminal 4 and body 2, due to spring-back of the bent portions.

With the appearance of gap 8, terminals 4 are deflected proportionately with the dimension of gap 8, when vibrations of an automobile reach body 2 via board 5. Repeating such the alternative deflections in a reciprocating motion causes body 2 to vibrate like as a pendulum. With such the repeated vibrations, stresses are concentrated because bent portions 9 of terminals 4 and boundaries 10 between terminals 4 and fillets of solder 7 serve as fulcrums. As a result, bent portions 9 and boundaries 10 may undergo metal fatigue to be broken, resulting in disconnection of the coil component.

Hereinafter, with reference to the accompanying drawings, descriptions will be made regarding a coil component according to the embodiment, which is capable of preventing terminals from breaking due to such the vibrations, resulting in improved reliability as required for an automotive component.

Figure 1:
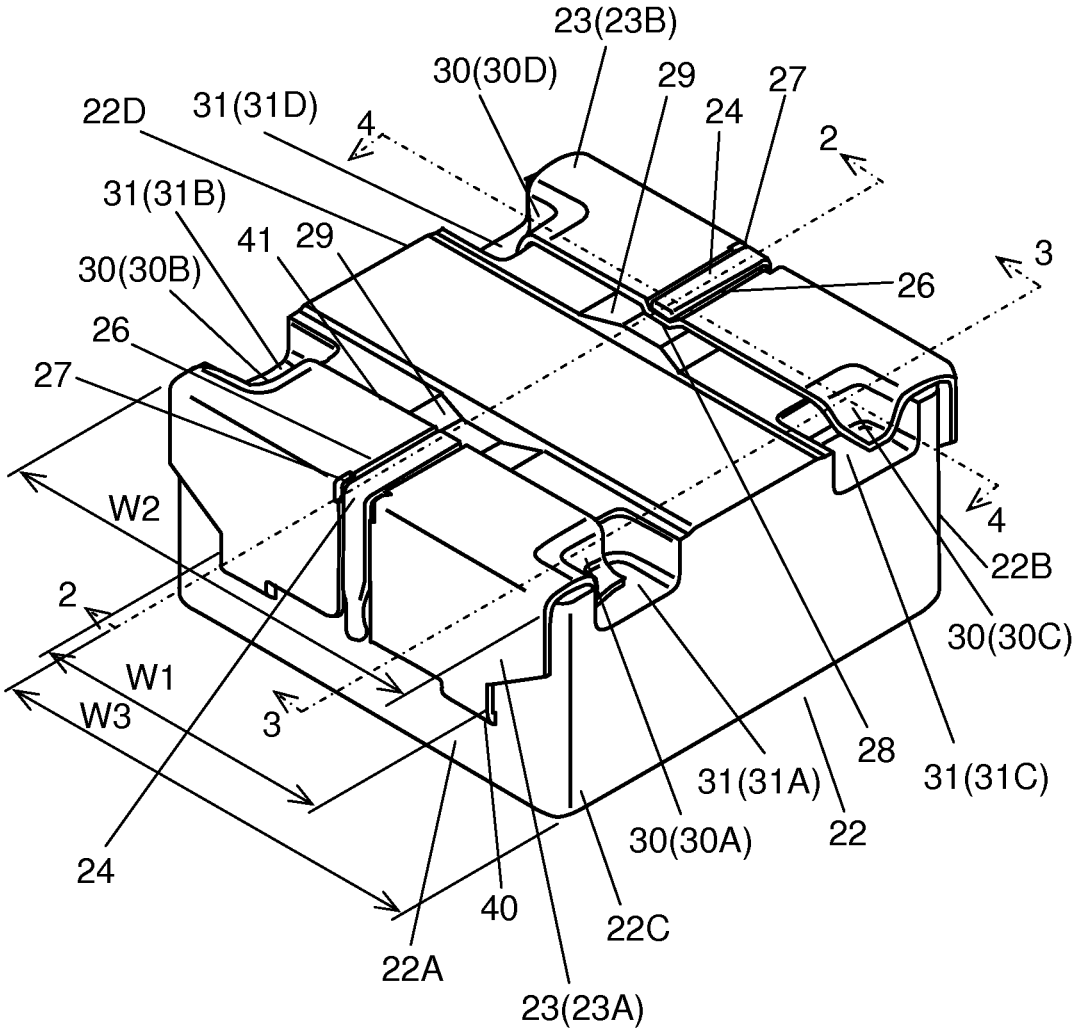
FIG. 1 is a perspective view of a coil component according to an embodiment, viewed from a bottom surface side.
Figure 2:
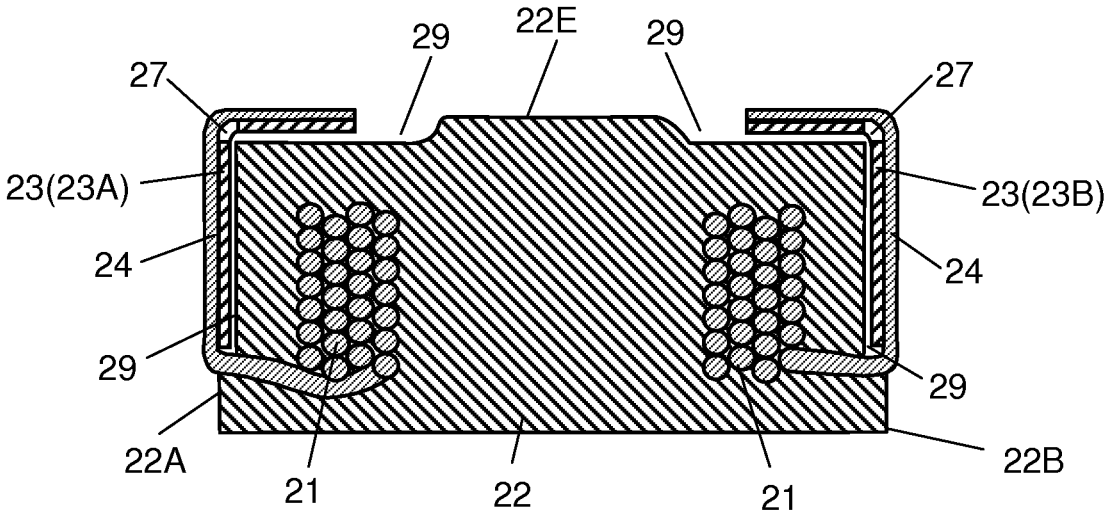
FIG. 2 is a cross-sectional view of the coil component taken along line 2-2 shown in FIG. 1.
Figure 3:
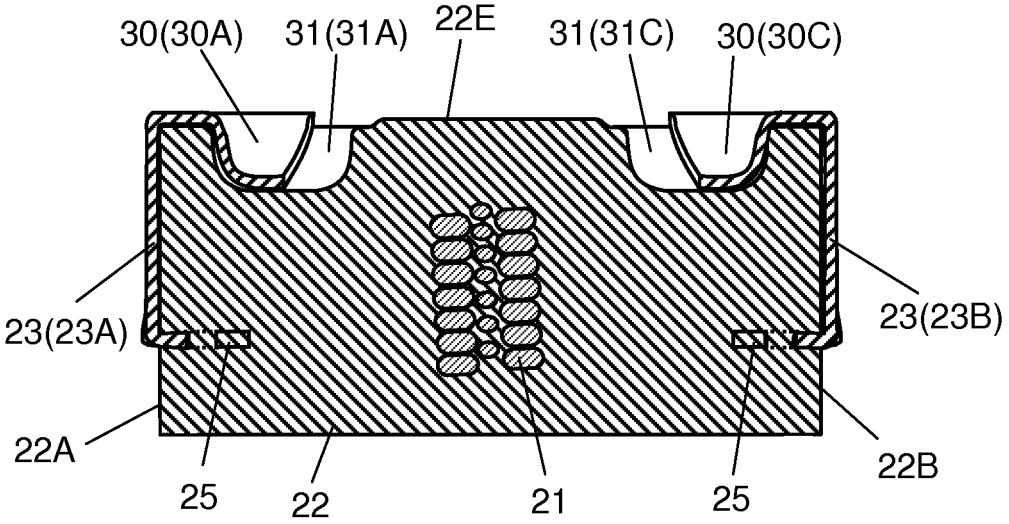
FIG. 3 is a cross-sectional view of the coil component taken along line 3-3 shown in FIG. 1.
Figure 4:
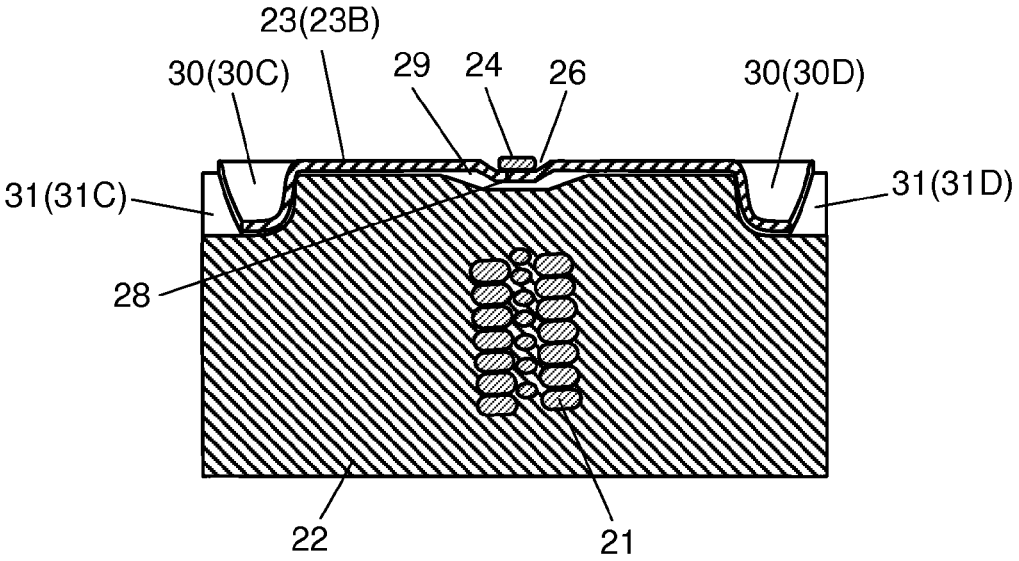
FIG. 4 is a cross-sectional view of the coil component taken along line 4-4 shown in FIG. 1.
Figure 5:
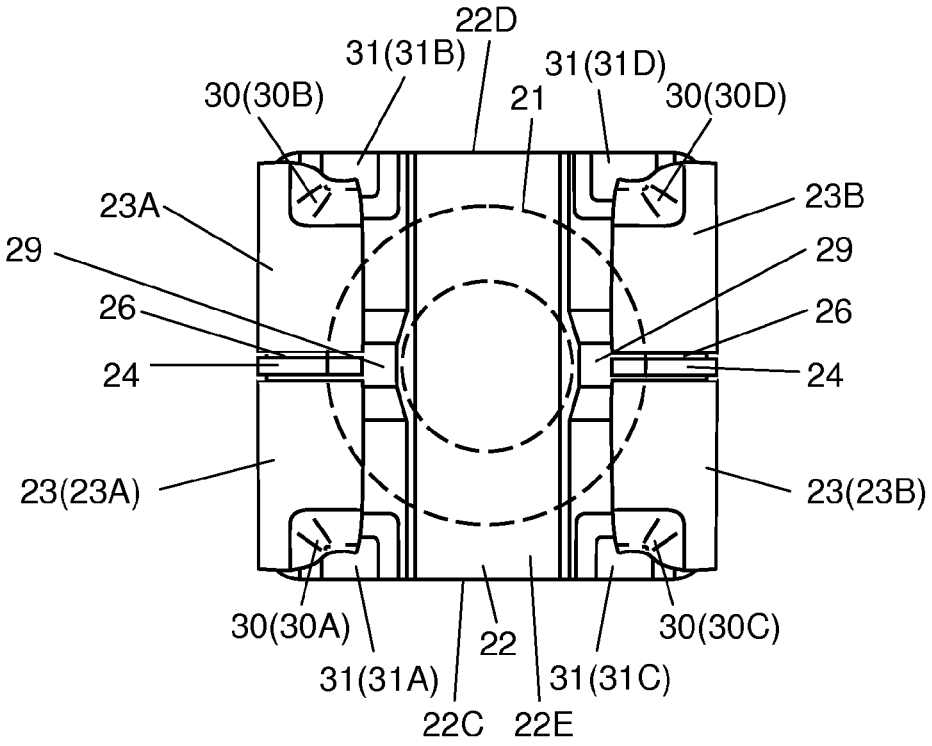
FIG. 5 is a perspective plan view of the coil component shown in FIG. 1, viewed from the bottom surface side.
Figure 6:
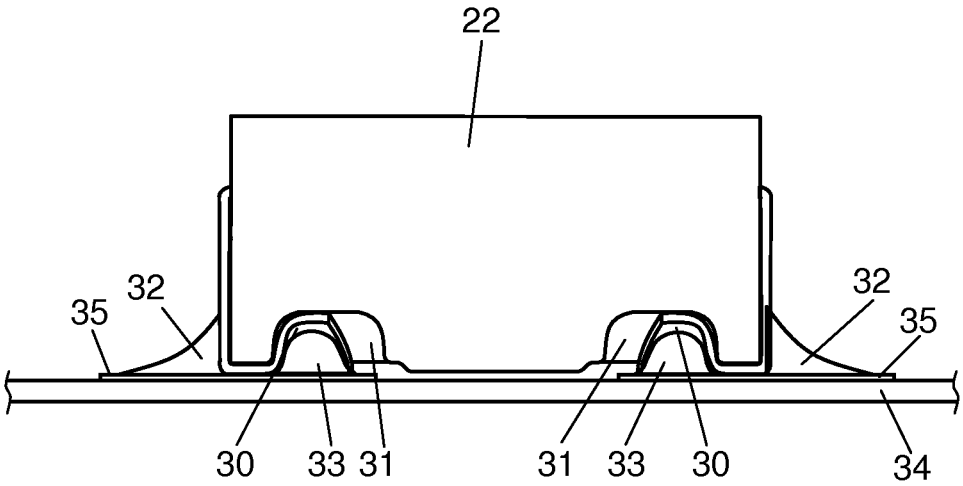
FIG. 6 is a side view illustrating a state in which the coil component shown in FIG. 1 is mounted on a board.

FIG. 1 is a perspective view of the coil component according to the present embodiment, viewed from a bottom surface side. FIGS. 2 to 4 are cross-sectional views of the coil component shown in FIG. 1. FIG. 2 shows the cross-sectional view taken along line 2-2; FIG. 3 shows the cross-sectional view taken along line 3-3; FIG. 4 shows the cross-sectional view taken along line 4-4. FIG. 5 is a perspective plan view of the coil component, viewed from the bottom surface side. FIG. 6 is a side view illustrating a state in which the coil component is mounted on a board.

The coil component according to the embodiment includes coil element 21, body 22 having a square pole shape, and a pair of terminals 23 (first terminal 23A and second terminal 23B).

Coil element 21 is buried in body 22. That is, body 22 accommodates coil element 21 therein. Body 22 includes first side surface 22A, second side surface 22B opposite to first side surface 22A, third side surface 22C orthogonal to first side surface 22A, fourth side surface 22D opposite to third side surface 22C, and bottom surface 22E orthogonal to first side surface 22A to fourth side surface 22D. Hereinafter, first side surface 22A to fourth side surface 22D are referred to as side surfaces 22A to 22D.

First terminal 23A is coupled with one end of coil element 21. First terminal 23A includes first end 40 fixed on side surface 22A and second end 41 disposed on bottom surface 22E. Second end 41 includes a pair of corner parts 30 (30A and 30B) located in both side portions of second end 41. First terminal 23A is formed by bending a plate material from side surface 22A toward bottom surface 22E. Similarly, second terminal 23B is coupled with another end of coil element 21. Second terminal 23B includes a first end fixed on side surface 22B, and a second end disposed on bottom surface 22E. The second end includes a pair of corner parts 30 (30C and 30D) located in both side portions thereof. Second terminal 23B is formed by bending a plate material from side surface 22B toward bottom surface 22E. In this way, first terminal 23A and second terminal 23B of a surface-mounting type are provided.

Bottom surface 22E is provided with four of recesses 31 (first recess 31A to fourth recess 31D) which are recessed from bottom surface 22E. First recess 31A and third recess 31C penetrate to side surface 22C, while second recess 31B and fourth recess 31D penetrate to side surface 22D. Hereinafter, first recess 31A to fourth recess 31D are referred to as recesses 31A to 31D.

Corner parts 30A and 30B of first terminal 23A are bent along the inner walls of recesses 31A and 31B, respectively. With this configuration, corner parts 30A and 30B are locked on bottom surface 22E. Similarly, corner parts 30C and 30D of second terminal 23B are bent along the inner walls of recesses 31C and 31D, respectively. With this configuration, corner parts 30C and 30D are locked on bottom surface 22E.

Note that, as shown in FIG. 5, recesses 31A to 31D are located so as not to overlap with coil element 21, viewed from bottom surface 22E.

Next, each part will be described. Coil element 21 is formed by winding a copper wire covered with an insulating film with a fusion bonding layer, in a cylindrical and helical fashion. Coil element 21 has no core (an air core). For example, coil element 21 is formed as follows: A copper wire with a diameter of 0.28 mm is prepared. The wire is wound in 40 turns with an axial diameter of 4.0 mm. Lead wires 24 of both ends of the wire are drawn in the opposite directions to each other. After that, the fusion bonding layer undergoes a hardening reaction to hold the shape.

Body 22 is formed with a magnetic material prepared as follows: A magnetic metal powder containing iron as a principal component is prepared. The powder is mixed with a thermosetting resin such as an epoxy resin, as a binder. The resulting mixture is granulated into a granular powder. In the magnetic material, coil element 21 and the one end of each of terminals 23 are buried.

Terminals 23 are formed of metal plates. For example, a phosphor bronze plate with a thickness of 0.2 mm is used to form terminals 23. Terminals 23 are electrically coupled with lead wires 24 of coil element 21. Each of first end 40 fixed on side surface 22A and the first end fixed on side surface 22B is formed in a C-shape to have two projections 25. Projections 25 are buried in body 22.

Lead wires 24 may be coupled with terminals 23 in one of the following manners: That is, lead wires 24 are coupled with coupling parts which are formed in projections 25 inside body 22; lead wires 24 are coupled with terminals 23 at locations adjacent to projections 25 outside body 22. In this embodiment, however, housing groove 26 is formed by press working in the center of each of terminals 23 along the direction in which each of terminal 23 extends. Housing groove 26 houses lead wire 24 therein and the both are integrally welded by electric welding such as resistance welding, to be electrically coupled with each other.

In this way, lead wires 24 are preferably disposed in housing grooves 26. With this configuration, when terminals 23 are bent from the side surfaces of body 22 toward the bottom surface, lead wires 24 as well are disposed on the bottom surface of body 22. For this reason, even when the diameter of the copper wire is so small, i.e. on the order of 0.28 mm, the shape of lead wire 24 is held by terminal 23 serving as a holding member. As a result, it is possible to couple lead wires 24 directly with lands 35 of mount board 34. Consequently, this eliminates the occurrence of failures such as disconnection o coming away of terminals 23 from lead wires 24, resulting in improved reliability of the coil component, in comparison with the case where lead wires 24 are wired inside body 22 or lead wires 24 are coupled with terminals 23 at the locations adjacent to projections 25.

In a case where lead wire 24 is housed in housing groove 26, the diameter of lead wire 24 may be so large that lead wire 24 juts out of groove 26. In this case, it is preferable that lead wire 24 be subjected, in advance, to press working to flatten a portion thereof to be housed in groove 26. Alternatively, when electric welding, the height of lead wire 24 is preferably reduced to be equivalent to the height of the surface of terminal 23 by using a welding electrode (not shown). This configuration allows the improved flatness of mounting surfaces of terminals 23, resulting in the improved connectivity of the terminals to lands 35 of board 34.

Moreover, first terminal 23A is preferably provided with through hole 27 at a location thereof corresponding to the edge between side surface 22A and bottom surface 22E of body 22. Similarly, second terminal 23B is preferably provided with through hole 27 at a location thereof corresponding to the edge between side surface 22B and bottom surface 22E. With this configuration, when bending terminals 23, through holes 27 serve as draft clearance parts to prevent lead wires 24 from being extended. As a result, the reliability of the coil component is improved.

In this way, coil element 21 and projections 25 as the first ends of terminals 23, are buried in the magnetic material, and are then subjected to pressure molding by using a metal mold to form unhardened body 22. Note that the outer dimensions of body 22 in this state are 10.0 mm×10.0 mm×4.5 mm, for example.

Heat treatment of unhardened body 22 causes the thermosetting resin, serving as a binder, to harden to fix the first ends of terminals 23 to side surface 22A and side surface 22B, respectively. After the heat treatment of body 22, terminals 23 are respectively bent from side surface 22A and side surface 22B toward bottom surface 22E, which allows the second ends of terminals 23 to be disposed on bottom surface 22E of body 22.

When body 22 is formed, housing recesses 29 are preferably formed in side surfaces 22A and 22B, and bottom surface 22E of body 22. Each of housing recesses 29 houses projection 28 that protrudes on the back side of housing groove 26 formed by the press working of terminal 23. That is, each of housing recesses 29 has a width and depth enough to house projection 28. With this configuration, flat parts of terminals 23 fit side surfaces 22A and 22B, and bottom surface 22E.

Next, descriptions will be made regarding fixation between the second ends of terminals 23 and bottom surface 22E of body 22. As described earlier, the second ends of terminals 23 are disposed on bottom surface 22E, and include corner parts 30 located at the both side portions. In bottom surface 22E, four of recesses 31 are formed. Each of recesses 31 is formed to be recessed from bottom surface 22E, and to be cut away toward closer one of side surfaces 22C and 22D orthogonal to side surfaces 22A and 22B on which the first ends of terminals 23 are fixed. Recesses 31 are formed to have a depth of 1 mm, relative to the center portion of bottom surface 22E.

Then, each of corner parts 30 is bent along the inner wall of each of recesses 31, thereby corner parts 30 are locked on bottom surface 22E and the second ends of terminals 23 are fixed on bottom surface 22E.

After terminals 23 have been bent from side surfaces 22A and 22B toward bottom surface 22E, there is a possibility that spring-back occurs at the bent portions of terminals 23 along side surfaces 22A and 22B, which yields a gap between terminals 23 and body 22. However, in the configuration described above, corner parts 30 are bent along the inner walls of recesses 31. This bending causes stresses on terminals 23, which causes the portions of terminals 23 located on side surfaces 22A and 22B via the gap to be forcibly attracted to body 22. Consequently, terminals 23 are placed in contact with side surfaces 22A and 22B.

Moreover, because corner parts 30 are bent along and locked on the inner walls of recesses 31, the spring-back does not occur after corner parts 30 have been locked. Accordingly, terminals 23 are in contact with and fixed to side surfaces 22A and 22B and the inner walls of recesses 31.

As a result, even when the coil component according to the embodiment is mounted on board 34 and subjected to stresses due to vibrations of the automobile or the like, terminals 23 are not deflected because terminals 23 are in contact with body 22. Therefore, body 22 does not vibrate in a pendulum motion, preventing terminals 23 from being broken.

Note that each of recesses 31 includes a region confronting corner part 30. In the strict definition, recess 31 includes a region confronting not only the corner part 30 but also an outer edge portion of corner part 30. With the definition in this way, corner parts 30 can be easily bent along the inner walls of recesses 31, resulting in improved productivity.

FIG. 6 is a side view illustrating a state in which the coil component shown in FIG. 1 is mounted on board 34. Because recesses 31 penetrate to side surface 22C or side surface 22D, when the coil component is reflow-soldered on board 34, corner parts 30 bent along recesses 31 are subjected to hot air, resulting in ease of warming corner parts 30 as well. As a result, solder fillets (back fillets 33) can be formed also on corner parts 30 bent as shown in FIG. 6. On the other hand, on the portions of terminals 23 located along side surfaces 22A and 22B, solder fillets 32 are formed. When back fillets 33 are sufficiently large in size, back fillets 33 work synergistically with solder fillets 32 to improve resistance to vibrations.

The depth of recesses 31 is preferably three times or more of the thickness of terminals 23. With this configuration, it is possible to more reliably lock corner parts 30 on recesses 31, resulting in the formation of back fillets 33. On the other hand, when the depth of recesses 31 is larger than the distance between bottom surface 22E and coil element 21, the magnetic characteristics tend to deteriorate; therefore, the depth of recesses 31 is preferably formed smaller than the distance.

Note that, in the embodiment, body 22 configures a closed magnetic circuit core of coil element 21. As shown in FIG. 5, each of recesses 31 is disposed at the location closer to side surface 22A or side surface 22B than to the center of bottom surface 22E of body 22. That is, recesses 31 are disposed at the locations that do not overlap with coil element 21 indicated by the dashed line in FIG. 5, viewed from bottom surface 22E of body 22. For this reason, there is no influence on magnetic efficiency, resistance to vibrations is thus improved without deterioration in characteristics.

Moreover, corner parts 30 are preferably locked on the bottom surface of body 22 in such a following manner: Each of recesses 31 are formed in a rectangular parallelepiped shape, and each of corner parts 30 is bent along the two inner walls, orthogonal to each other, of recess 31. With this configuration, each of corner parts 30 is bent along the two inner walls, orthogonal to each other, of recess 31. This allows corner parts 30 to be more reliably locked on recesses 31. In addition, each of back fillets 33 is formed in not only one direction but also plural directions, which results in improved resistance to vibrations.

Moreover, corner parts 30 located at the both side portions are bent so as to pull each other. That is, corner part 30A and corner part 30B are bent such that the both pull each other, while corner part 30C and corner part 30D are bent such that the both pull each other. Accordingly, when corner parts 30 are bent, it is possible to prevent deterioration in flatness of the portions of terminals 23 disposed on bottom surface 22E.

Moreover, width W2 of terminals 23 located on bottom surface 22E shown in FIG. 1 is preferably not smaller than 90% of width W3 of side surfaces 22A and 22B, within a range where the terminals do not jut out of body 22. That is, the width of the portion, which is bent along bottom surface 22E, of first terminal 23A is preferably 90% or larger and 100% or less of the width of side surface 22A. The width of the portion, which is bent along bottom surface 22E, of second terminal 23B is preferably 90% or larger and 100% or less of the width of side surface 22B. This configuration allows resistance to vibrations to be improved. In addition, recesses 31 at which corner parts 30 are locked on bottom surface 22E are located close to corner parts of body 22. Therefore, recesses 31 do not overlap with coil element 21 formed in a cylindrical and helical shape.

Width W1 of the portion, protruding from side surface 22A or side surface 22B of body 22, of terminal 23 is 7.5 mm, for example. Width W2 of the portion, bent along bottom surface 22E, of terminal 23 is 9.5 mm, for example.

Note that, if width W1 of terminals 23 is made excessively large, body 22 tends to have a crack around terminals 23, when molding body 22. For this reason, it is preferable to satisfy the relation "W1<W2". That is, width W2 of the portion, bent along bottom surface 22E, of first terminal 23A is preferably larger than width W1 of the portion, fixed to side surface 22A of body 22, of first terminal 23A. Similarly, the width of the portion, bent along bottom surface 22E, of second terminal 23B is preferably larger than the width of the portion, fixed to second side surface 22B, of second terminal 23B.

Next, a method for manufacturing the coil component according to the embodiment will be described with reference to FIGS. 7 to 11. FIGS. 7 to 11 are views illustrating a procedure of manufacturing the coil component shown in FIG. 1.

Figure 7:
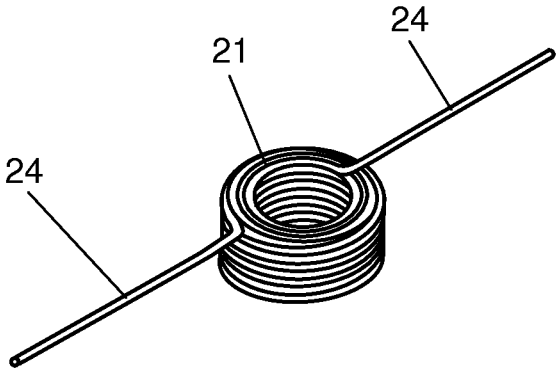
FIGS. 7 to 11 are views illustrating a procedure of manufacturing the coil component shown in FIG. 1.

First, as shown in FIG. 7, coil element 21 with an air core is formed by winding a copper wire covered with an insulating film with a fusion bonding layer in a cylindrical and helical shape. That is, the copper wire is wound on a not-shown winding shaft, and lead wires 24 of both ends of the wire are drawn in the opposite directions to each other. After that, the thus-wound portion is subjected to hot air blowing or solvent dripping to cause hardening reaction of the fusion bonding layer such that the shape of the wound portion is hold. Then, the coil is released from the winding shaft. In this way, coil element 21 with the air core is completed.

Figure 8:
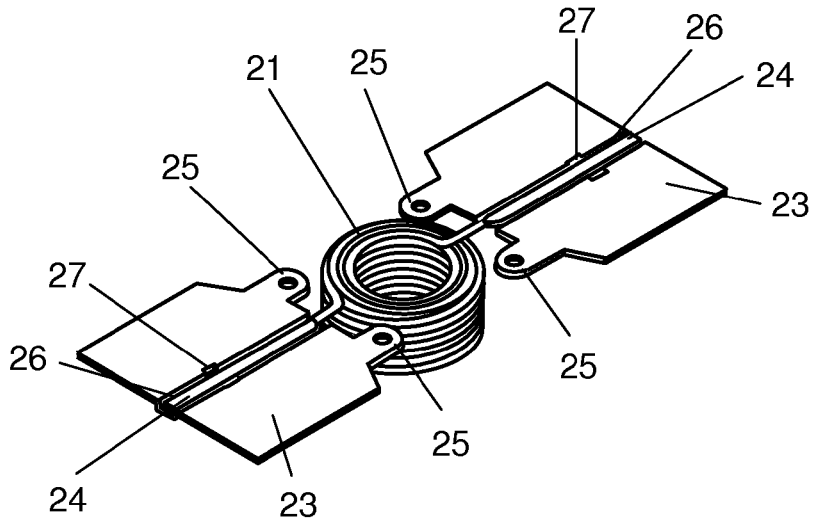

Next, as shown in FIG. 8, lead wires 24 are coupled with terminals 23, respectively. As described earlier, the first end of each of terminals 23 is formed in a C-shape. That is, two projections 25 are disposed in the first end of terminal 23.

Moreover, in the center of each of terminals 23 in the direction in which terminal 23 extends, housing groove 26 is formed which houses lead wire 24. In the location corresponding to the edge between side surface 22A or side surface 22B and bottom surface 22E of body 22, through hole 27 is disposed. Then, after the insulating film of lead wire 24 has been removed, lead wire 24 is accommodated in housing groove 26 of terminal 23. Lead wire 24 and terminal 23 are then integrally connected, by electric welding such as resistance welding, to be electrically coupled with each other.

When the diameter of lead wire 24 is larger than the depth of housing groove 26, lead wire 24 is flattened out by pressing an electrode of the resistance welding against the wire, or alternatively by applying press working to lead wire 24 in advance. With such a method, the outer surface of lead wire 24 is placed in the substantially same plane of the flat surface part, serving as a mounting surface, of terminal 23.

Note that, although terminals 23 may be processed to be coupled with the wires on a piece basis as shown in FIG. 8, they may be processed to be coupled on a continuous hoop material basis (not shown), resulting in improved productivity.

Figure 9:
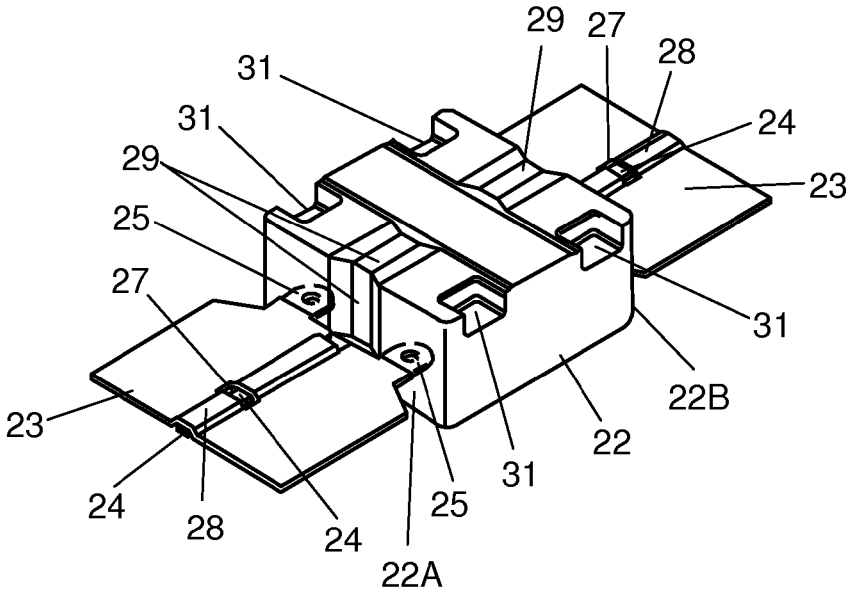

Next, the magnetic metal powder containing iron as a principal component is mixed with the thermosetting resin as a binder. The resulting mixture is granulated to prepare the magnetic material. Then, as shown in FIG. 9, the thus-prepared magnetic material, coil element 21, and projections 25 of terminals 23 are inserted together into a metal mold (not shown), and then subjected to pressure molding to form unhardened body 22.

At that time, by using the metal mold, housing recesses 29 are formed to house projections 28 located on the back sides of housing grooves 26 of terminals 23 such that each of housing recesses 29 extends from side surface 22A or 22B to bottom surface 22E of body 22, as shown in FIG. 1. In addition, recesses 31 are formed in bottom surface 22E of body 22. The shape of recesses 31 is as described earlier. Each of recesses 31 is formed in a rectangular parallelepiped shape, between corner parts 30 of terminals 23 confronting each other.

Heat treatment of unhardened body 22 causes the thermosetting resin serving as a binder to harden to strongly fix projections 25 of terminals 23 in side surface 22A and side surface 22B, respectively. After the heat treatment, solder plating is preferably formed on the surfaces of terminals 23 by, for example, dipping terminals 23 in melted solder, for better mounting on board 34.

Figure 10A:
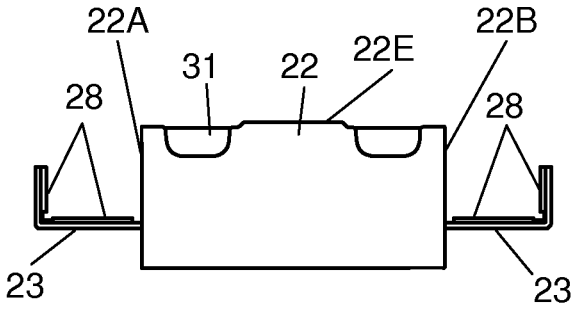
Figure 10B:
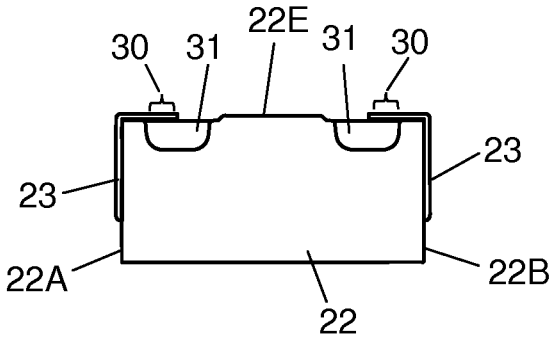
Figure 10C:
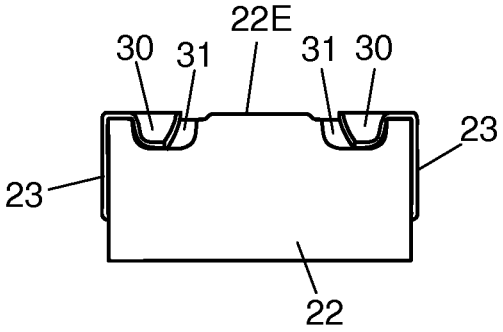

Next, as shown in FIGS. 10A to 10C, terminals 23 are bent from side surface 22A or 22B toward bottom surface 22E of body 22. FIGS. 10A to 10C are side views of the coil component, when assembling, according to the embodiment.

First, as shown in FIG. 10A, each of terminals 23 is bent at locations corresponding to the edge between side surface 22A or 22B and bottom surface 22E of body 22.

Next, as shown in FIG. 10B, the portions, of terminals 23, which protrude from side surfaces 22A and 22B of body 22 are bent along side surfaces 22A and 22B, respectively. At that time, projections 28 of terminals 23 are housed in housing recesses 29 formed in body 22 such that terminals 23 are bent with the flat surface parts thereof fitting body 22.

Finally, as shown in FIG. 10C, each of corner parts 30 is bent along the two inner walls, orthogonal to each other, of recess 31 to lock terminals 23 on recesses 31.

Figure 11:
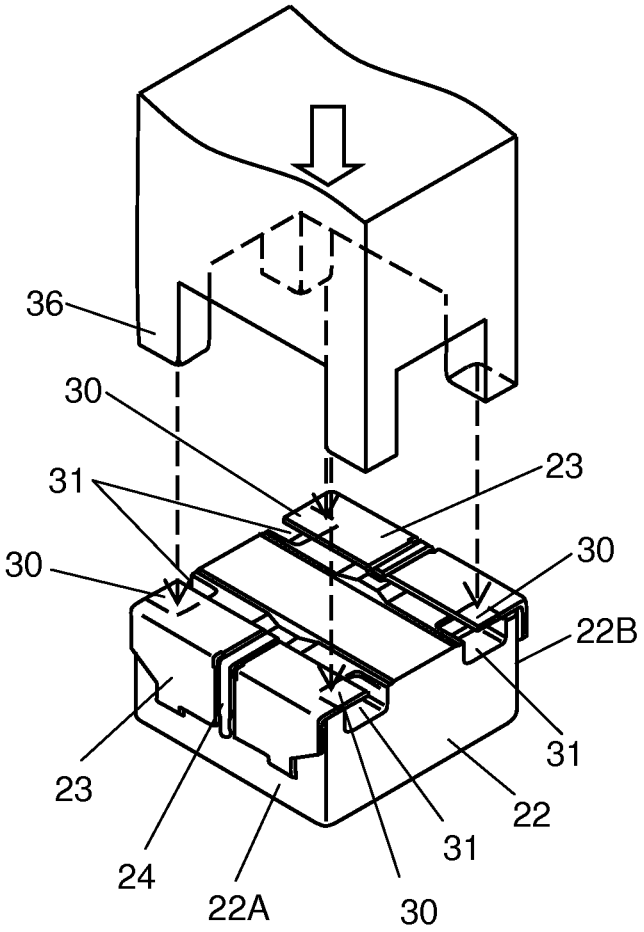

The method for bending corner parts 30 of terminals 23 will be described in more detail, with reference to FIG. 11. Punch 36 is prepared which has projections close in shape to recesses 31 and capable to be fit into recesses 31. Then, punch 36 is pushed into recesses 31 in the direction indicated by the arrow while the punch is in contact with corner parts 30 of terminals 23. This operation causes corner parts 30 of terminals 23 to be bent. The height of the projections of punch 36 is equal to the value obtained by subtracting the thickness of terminals 23 from the depth of recesses 31.

By pressing such punch 36 against corner parts 30 of terminals 23, each of corner parts 30 can be swaged and bent along the two inner walls, orthogonal to each other, of recess 31. As a result, it is possible to reliably lock corner parts 30 in recesses 31.

Moreover, the use of punch 36 allows four corner parts 30 to be swaged and bent at once. Therefore, terminals 23 are attracted to side surfaces 22A and 22B in good balance between them, which prevents a gap between body 22 and terminals 23 from generating. Furthermore, in one of terminals 23, corner parts 30 of both sides are bent such that corner parts 30 pull each other. That is, corner part 30A and corner part 30B are bent such that the both pull each other, while corner part 30C and corner part 30D are bent such that the both pull each other. In this way, corner parts 30 act to attract each other in balance. There is no case where one of the corner parts attracts the other to cause a tilt of terminal 23. Accordingly, it is possible to bend corner parts 30 without any degradation in flatness of the portions, disposed on bottom surface 22E, of terminals 23.

With the procedure described above, it is possible to manufacture the surface-mounting-type coil component shown in FIG. 1.

Note that, in the above descriptions, body 22 is formed by pressure molding of the magnetic material. Alternatively, body 22 may be formed by placing the circuit components in a plastic container, followed by filling it with a resin. In this case, the first ends of the terminals may be fixed on the side surfaces of the container, and then the corner parts of the second ends of the terminals may be bent along and locked on the recesses formed in the bottom surface of the container.

As described above, the coil component according to the embodiment is configured such that the terminals are in contact with and fixed to the side surfaces of the body and the inner walls of the recesses formed in the bottom surface of the body. This configuration prevents the body from vibrating in a pendulum motion leading to breaking terminals, thus reliability of the coil component is improved. Consequently, the coil component is industrially useful.

What is claimed is:

1. A coil component comprising:

a coil element;

a body accommodating the coil element therein, having a square pole shape and including:

a first side surface;

a second side surface opposite to the first side surface;

a third side surface orthogonal to the first side surface;

a fourth side surface opposite to the third side surface; and a bottom surface orthogonal to the first to fourth side surfaces, a first terminal formed by bending a plate member from the first side surface toward the bottom surface, the first terminal including:

a first end coupled with the coil element and fixed to the first side surface of the body; and a second end disposed on the bottom surface of the body and including a pair of corner parts located in both side portions of the second end of the first terminal; and a second terminal formed by bending a plate member from the second side surface toward the bottom surface, the second terminal including:

a first end coupled with the coil element and fixed to the second side surface of the body; and a second end disposed on the bottom surface of the body and including a pair of corner parts located in both side portions of the second end of the second terminal, wherein the bottom surface of the body is provided with first to fourth recesses recessed from the bottom surface of the body, the first and third recesses penetrating to the third side surface, the second and fourth recesses penetrating to the fourth side surface, the pair of the corner parts of the first terminal are bent along inner walls of the first and second recesses, respectively, so as to be locked on the bottom surface of the body, the pair of the corner parts of the second terminal are bent along inner walls of the third and fourth recesses, respectively, so as to be locked on the bottom surface of the body, the first to fourth recesses are located so as not to overlap with the coil element, viewed from the bottom surface of the body, the first recess is provided apart from a corner portion of the body where the bottom surface, the first side surface and the third side surface intersect with each other, the second recess is provided apart from a corner portion of the body where the bottom surface, the first side surface and the fourth side surface intersect with each other, the third recess is provided apart from a corner portion of the body where the bottom surface, the second side surface and the third side surface intersect with each other, and the fourth recess is provided apart from a corner portion of the body where the bottom surface, the second side surface and the fourth side surface intersect with each other.

2. The coil component according to claim 1, wherein in the first terminal a width of a portion bent along the bottom surface of the body is larger than a width of a portion fixed to the first side surface of the body, and in the second terminal, a width of a portion bent along the bottom surface of the body is larger than a width of a portion fixed to the second side surface of the body.

3. The coil component according to claim 1, wherein a width of a portion, bent along the bottom surface of the body, of the first terminal is in a range from 90% to 100%, inclusive, of a width of the first side surface; and a width of a portion, bent along the bottom surface of the body, of the second terminal is in a range from 90% to 100%, inclusive, of a width of the second side surface.

4. The coil component according to claim 1, wherein the coil element has a first lead wire connected to the first terminal and a second lead wire connected to the second terminal at each end, the first terminal is provided with a first housing groove in a center of the first terminal along a direction in which the first terminal extends, and the first lead wire is housed in the first housing groove and connected to the first terminal in the first housing groove, and the second terminal is provided with a second housing groove in a center of the second terminal along a direction in which the second terminal extends, and the second lead wire is housed in the second housing groove and connected to the second terminal in the second housing groove.

5. The coil component according to claim 1, wherein each of the first to fourth recesses are formed in a rectangular parallelepiped shape, each of the corner parts of the first terminal is bent along two inner walls orthogonal to each other in each of the first and second recesses, and each of the corner parts of the second terminal is bent along two inner walls orthogonal to each other in each of the third and fourth recesses.

6. A coil component comprising:

a coil element;

a body accommodating the coil element therein, having a square pole shape and including:

a first side surface;

a second side surface opposite to the first side surface;

a third side surface orthogonal to the first side surface;

a fourth side surface opposite to the third side surface; and a bottom surface orthogonal to the first to fourth side surfaces, a first terminal formed by bending a plate member from the first side surface toward the bottom surface, the first terminal including:

a first end coupled with the coil element and fixed to the first side surface of the body; and a second end disposed on the bottom surface of the body and including a pair of corner parts located in both side portions of the second end of the first terminal; and a second terminal formed by bending a plate member from the second side surface toward the bottom surface, the second terminal including:

a first end coupled with the coil element and fixed to the second side surface of the body; and a second end disposed on the bottom surface of the body and including a pair of corner parts located in both side portions of the second end of the second terminal, wherein the bottom surface of the body is provided with first to fourth recesses recessed from the bottom surface of the body and each formed in a rectangular parallelepiped shape, the first and third recesses penetrating to the third side surface, the second and fourth recesses penetrating to the fourth side surface, the pair of the corner parts of the first terminal are bent along two inner walls orthogonal to each other in each of the first and second recesses so as to be locked on the bottom surface of the body, the pair of the corner parts of the second terminal are bent along two inner walls orthogonal to each other in each of the third and fourth recesses so as to be locked on the bottom surface of the body, and the first to fourth recesses are located so as not to overlap with the coil element, viewed from the bottom surface of the body.

7. The coil component according to claim 6, wherein the first end of the first terminal is buried in the body from the first side surface of the body, and the first end of the second terminal is buried in the body from the second side surface of the body.

8. The coil component according to claim 6, wherein in the first terminal a width of a portion bent along the bottom surface of the body is larger than a width of a portion fixed to the first side surface of the body, and in the second terminal, a width of a portion bent along the bottom surface of the body is larger than a width of a portion fixed to the second side surface of the body.

9. The coil component according to claim 6, wherein a width of a portion, bent along the bottom surface of the body, of the first terminal is in a range from 90% to 100%, inclusive, of a width of the first side surface; and a width of a portion, bent along the bottom surface of the body, of the second terminal is in a range from 90% to 100%, inclusive, of a width of the second side surface.

10. The coil component according to claim 1, wherein the first end of the first terminal is buried in the body from the first side surface of the body, and the first end of the second terminal is buried in the body from the second side surface of the body.

11. The coil component according to claim 7, wherein the coil element has a first lead wire connected to the first terminal and a second lead wire connected to the second terminal at each end, the first terminal is provided with a first housing groove in a center of the first terminal along a direction in which the first terminal extends, and the first lead wire is housed in the first housing groove and connected to the first terminal in the first housing groove, and the second terminal is provided with a second housing groove in a center of the second terminal along a direction in which the second terminal extends, and the second lead wire is housed in the second housing groove and connected to the second terminal in the second housing groove.

* * * * *